US008685181B2

(12) United States Patent
Lee et al.

(10) Patent No.: US 8,685,181 B2
(45) Date of Patent: Apr. 1, 2014

(54) MANUFACTURING METHOD OF CARBON STEEL SHEET SUPERIOR IN FORMABILITY

(75) Inventors: Kyoo-Young Lee, Gwangju (KR); Gyo-Sung Kim, Pohang (KR); Han-Chul Shin, Pohang (KR); Chang-Hoon Lee, Kyungsan (KR); Kee-Cheol Park, Pohang (KR); Jea-Chun Jeon, Pohang (KR)

(73) Assignee: Posco (KR)

( * ) Notice: Subject to any disclaimer, the term of this patent is extended or adjusted under 35 U.S.C. 154(b) by 0 days.

(21) Appl. No.: 13/471,529

(22) Filed: May 15, 2012

(65) Prior Publication Data

US 2012/0222786 A1 Sep. 6, 2012

Related U.S. Application Data

(62) Division of application No. 12/158,961, filed as application No. PCT/KR2006/005719 on Dec. 26, 2006, now Pat. No. 8,197,616.

(30) Foreign Application Priority Data

Dec. 26, 2005 (KR) ..... 10-2005-0130127
Nov. 2, 2006 (KR) ..... 10-2006-0107739

(51) Int. Cl.

| | |
|---|---|
| ***C21D 8/02*** | (2006.01) |
| ***C22C 38/04*** | (2006.01) |
| ***C22C 38/14*** | (2006.01) |
| ***C22C 38/32*** | (2006.01) |

(52) U.S. Cl.

USPC ..... 148/330; 148/333; 148/654; 148/602

(58) Field of Classification Search

USPC ..... 148/320, 330, 333, 654, 602; 420/121, 420/126, 128

See application file for complete search history.

(56) References Cited

U.S. PATENT DOCUMENTS

| | | | |
|---|---|---|---|
| 3,508,911 | A | 4/1970 | Riedel |
| 3,987,245 | A | 10/1976 | Faesen et al. |
| 5,108,518 | A | 4/1992 | Fukui et al. |
| 6,296,805 | B1 | 10/2001 | Laurent et al. |
| 6,364,968 | B1 | 4/2002 | Yasuhara et al. |
| 6,589,369 | B2 | 7/2003 | Yokoi et al. |
| 6,652,671 | B2 | 11/2003 | Nakamura et al. |
| 7,105,066 | B2 | 9/2006 | Jeong et al. |

FOREIGN PATENT DOCUMENTS

| | | | |
|---|---|---|---|
| CN | 1358236 | A | 7/2002 |
| EP | 0971044 | A1 | 1/2000 |
| EP | 1013785 | A1 | 6/2000 |
| FR | 2833504 | A1 | 6/2003 |
| JP | 10096032 | A | 4/1998 |

(Continued)

*Primary Examiner* — Deborah Yee

(74) *Attorney, Agent, or Firm* — The Webb Law Firm

(57) ABSTRACT

A carbon steel sheet having high formability due to a microscopic and uniform carbide distribution and having a good characteristic of final heat treatment, and a manufacturing method thereof. The carbon steel sheet having excellent formability includes, in wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at less than or equal to 0.5×48/14×[N]% to 0.03% when the condition of B and N is not satisfied, B at 0.0005-0.0080%, N at less than or equal to 0.006%, Fe, and extra inevitable elements; an average size of carbide is less than or equal to 1 μm; and an average grain size of ferrite is less than or equal to 5 μm.

3 Claims, 4 Drawing Sheets

(56) References Cited

FOREIGN PATENT DOCUMENTS

| | | | | |
|---|---|---|---|---|
| JP | 10265845 | A | | 10/1998 |
| JP | 11269552 | A | | 10/1999 |
| JP | 11269553 | A | | 10/1999 |
| JP | 2005-133199 | A | * | 5/2000 |
| JP | 2001140037 | A | | 5/2001 |
| JP | 2003013144 | A | | 1/2003 |
| JP | 2003013145 | A | | 1/2003 |
| JP | 2005097740 | A | | 4/2005 |
| JP | 2005133200 | A | | 5/2005 |
| JP | 2005290547 | A | | 10/2005 |
| JP | 2006063394 | A | | 3/2006 |
| KR | 20030076430 | A | | 9/2003 |
| WO | 03042420 | A1 | | 5/2003 |

* cited by examiner

MANUFACTURING METHOD OF CARBON STEEL SHEET SUPERIOR IN FORMABILITY

CROSS REFERENCE TO RELATED APPLICATIONS

This application is a division of U.S. patent application Ser. No. 12/158,961 filed Jun. 23, 2008 now U.S. Pat. No. 8,197,616, which is a national phase filing of PCT/KR2006/005719 filed Dec. 26, 2006, which claims priority to KR 10-2006-0107739 filed Nov. 2, 2006, and KR 10-2005-0130127 filed Dec. 26, 2005, all of which are incorporated by reference herein in their entireties.

BACKGROUND OF THE INVENTION

1. Field of the Invention

The present invention relates to a carbon steel sheet having high formability and a manufacturing method thereof. More particularly, the present invention relates to a carbon steel sheet having a microscopic and uniform carbide distribution, a fine grain of ferritic phase, and high formability, and a manufacturing method thereof.

2. Description of the Related Art

Typical high carbon steel used for fabricating tools or vehicle parts is applied with a spheroidizing annealing process for transforming a pearlite texture to a spheroidized cementite, after it is produced in the form of a hot rolling steel sheet. A long period of annealing is required for complete spheroidizing. Accordingly, production cost increases and productivity is deteriorated.

In order to manufacture the hot rolling steel sheet, typical processes such as drawing, deforming, stretch flanging, and bending are typically applied to the high carbon steel for the fabrication after the hot rolling and winding and the spheroidizing annealing.

When the high carbon steel is made of a two phase structure including ferrite and cementite, the formability during fabricating the desired parts is significantly affected by the shapes, sizes, and distribution of the ferrite and the cementite. In the case of a high carbon steel having a substantial amount of free ferrite texture, although it shows high ductility since carbide is not resident in the free ferrite, a stretch flange formability thereof (which can be graded by a hole expansion ratio) is not always excellent.

A texture of a high carbon steel having free ferrite and ferrite including spheroidized carbide includes the carbide in a larger size than that of the high carbon steel that only has the ferrite including carbide.

Therefore, holes expand during the fabrication process such that a deformation difference occurs between the free ferrite and the ferrite including the spheroidized carbide. In order to maintain continuity in the deformation of material, the deformation is concentrated on an interface between the relatively coarse carbide and the ferrite. Such a concentration of deformation causes generation of voids on the interface that can grow to a crack, and consequently stretch flange formability may be deteriorated.

When the steel having a texture of the ferrite and the pearlite is applied with the spheroidizing annealing, the spheroidizing annealing time is attempted to be reduced by processing a cold rolling after a hot rolling. In addition, when a gap in the lamellar structure of the carbide in the pearlite texture becomes narrower, i.e., when the texture becomes finer, the spheroidizing speed is improved such that the time for finishing the spheroidizing becomes shorter. However, in this case also, a batch annealing furnace (BAF) heat treatment is still required for a long time.

The high carbon steel for the fabrication is applied with a process for increasing the hardness such as a subsequent cooling process of quench hardening after an austenization heat treatment. In this case, when the size and/or thickness of the material is small, the hardness may become uniform over the entire material. However, when the size and/or thickness of the material is not small, the hardness may easily become non-uniform. In many precision parts such as vehicle parts, a hardness deviation results in a deviation of durability. Therefore, obtaining uniformity of material distribution after the heat treatment is very important.

Methods for solving the problem of the non-uniform material distribution are found in Japanese Patent laid-open publication No. 11-269552, Japanese Patent laid-open publication No. 11-269553, U.S. Pat. No. 6,589,369, Japanese Patent laid-open publication No. 2003-13144, and Japanese Patent laid-open publication No. 2003-13145.

Firstly, according to Japanese Patent laid-open publication No. 11-269552 and Japanese Patent laid-open publication No. 11-269553, a hot rolling steel sheet having a free ferrite area ratio above $0.4\times(1-[C]\%/0.8)\times100$ and pearlite lamellar gap above 0.1 μm is fabricated from a metal texture of a substantially ferrite and pearlite texture, using steel having 0.1 to 0.8 wt % of carbon. Then, after processing cold rolling by more than 15%, a two step heating pattern is applied. Subsequently, the material is cooled and maintained at a predetermined temperature. Thus, a high or intermediate carbon steel sheet having high stretch flange formability is manufactured by applying three steps of heating patterns.

However, such a method is understood to have a drawback in that production cost increases since the cold rolling is performed before the spheroidizing annealing.

In addition, U.S. Pat. No. 6,589,369 discloses a method for fabricating steel plate having high stretch flange formability. C at 0.01 to 0.3 wt %, Si at 0.01 to 2 wt %, Mn at 0.05 to 3 wt %, P at less than 0.1 wt %, S at less than 0.01 wt %, and Al at 0.005 to 1 wt % are contained in the steel plate. Ferrite is used as a first phase. Martensite or residual austenite is used as a second phase. A quotient in a division of volume fraction of the second phase by average grain size is 3-12. A quotient in a division of an average hardness value of the second phase by an average hardness value of the ferrite is 1.5-7.

However, such a method cannot provide a high hardness value that is obtained by a cooling process after the austenitation heat treatment, which is an important factor in a typical high carbon steel. In addition, a uniform carbide distribution cannot be achieved when applying the spheroidizing heat treatment, and thus, the hole expansion ratio is deteriorated after final spheroidizing.

According to Japanese Patent laid-open publication No. 2003-13144 and Japanese Patent laid-open publication No. 2003-13145, a hot rolled or cold rolled carbon steel sheet having a high stretch flange formability is produced. In the method, a hot rolled carbon steel sheet is fabricated by hot rolling a C-steel of 0.2 to 0.7 wt % at a temperature above Ar3-20° C., cooling at a cooling speed of more than 120° C./second, stopping the cooling at a temperature above 650° C., subsequently cooling at a temperature below 600° C., applying pickling, and then annealing at a temperature of 650° C. to $Ac_1$ temperature after pickling. The cold rolled carbon steel sheet is fabricated by application of cold rolling of above 30% after the pickling of the hot rolling steel sheet, and then annealing at a temperature of 600° C. to Ac1 temperature.

According to the above method, the cooling at the cooling speed of more than 120° C./second after the hot rolling is not possible in a typical hot rolling factory, and thus a cooling apparatus that is specially designed for that purpose is required, which causes a drawback of high cost.

SUMMARY OF THE INVENTION

The present invention has been made in an effort to solve the above-mentioned problem of the prior art. The present invention provides a carbon steel sheet having high stretch flange formability due to a microscopic and uniform carbide distribution and having a good characteristic of final heat treatment, and a manufacturing method thereof.

In order to achieve the above technical object, according to an exemplary embodiment of the present invention, a carbon steel sheet having excellent stretch flange formability and an excellent final heat treatment characteristic is provided. This carbon steel sheet includes, in the unit of wt %, C at 0.2-0.5%, Mn at 0.2-1.0%, Si at less than or equal to 0.4%, Cr at less than or equal to 0.5%, Al at 0.01-0.1%, S at less than or equal to 0.012%, Ti at 0.5×48/14×[N] to 0.03%, B at 0.0005-0.0080%, N at less than or equal to 0.006%, Fe, and additional inevitable impurities. An average particle size of carbide in the carbon steel sheet is less than or equal to 1 μm, and an average grain size of ferrite in the carbon steel sheet is less than or equal to 5 μm.

According to another embodiment of the present invention, a carbon steel sheet having a different composition and having excellent stretch flange formability and an excellent final heat treatment characteristic is provided. This carbon steel sheet includes, in the unit of wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at less than 0.5×48/14×[N] %, B at 0.0005-0.0080%, N at less than or equal to 0.006%, Fe, and extra inevitable impurities, where the condition of B(atomic %)/N (atomic %)>1 is satisfied. An average particle size of carbide in the carbon steel sheet is less than or equal to 1 μm, and an average grain size of ferrite in the carbon steel sheet is less than or equal to 5 μm.

In the carbon steel sheets according to the embodiments of the present invention, fractions of free ferrite and pearlite having a lamellar carbide structure are respectively less than or equal to 5%, and that of bainite is greater than or equal to 90%.

According to still another embodiment of the present invention, a method for manufacturing a carbon steel sheet having a high stretch flange formability and having a good characteristic of final heat treatment is provided. This method includes: manufacturing a steel slab that includes, in the unit of wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at 0.5×48/14×[N] to 0.03%, B at 0.0005-0.0080%, N at less than or equal to 0.006%, Fe, and extra inevitable impurities; reheating and hot finish rolling the slab at a temperature above an $Ar_3$ transformation temperature; cooling a hot rolled steel sheet manufactured by the hot finish rolling at a cooling speed in a range of 20° C./sec-100° C./sec; and manufacturing a hot rolled coil by winding the cooled hot rolled steel sheet at a temperature in a range of Ms (martensite transformation temperature) to 530° C.

According to still another embodiment of the present invention, a method for manufacturing a carbon steel sheet having a different composition, having a high stretch flange formability, and having a good characteristic of final heat treatment is provided. This method includes: manufacturing a steel slab that includes, in the unit of wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at less than 0.5×48/14×[N] %, B at 0.0005-0.0080%, N at less than or equal to 0.006%, Fe, and extra inevitable impurities, where the condition of B(atomic %)/N (atomic %)>1 is satisfied; manufacturing a hot rolled steel sheet by reheating and hot rolling the slab with a finishing temperature that is greater than or equal to an $Ar_a$ transformation temperature; cooling the hot rolled steel sheet at a cooling speed in a range of 20° C./sec-100° C./sec; and manufacturing a hot rolled coil by winding the cooled hot rolled steel sheet at a temperature in a range of Ms to 530° C.

The manufacturing method of the carbon steel sheet according to embodiments of the present invention further includes annealing the hot rolled steel sheet at a temperature range of 600° C. to $Ac_1$ transformation temperature without involving cold rolling.

DETAILED DESCRIPTION OF THE INVENTION

Figure 1:
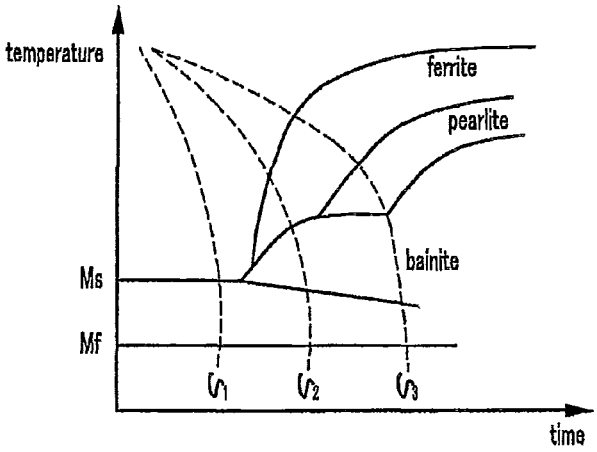
FIG. 1 is a diagram illustrating a continuous cooling of steel that is not added with boron (B)

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Unless explicitly described to the contrary, the word "comprise" will be understood to imply the inclusion of stated elements but not the exclusion of any other elements.

Chemical composition of a carbon steel sheet according to an exemplary embodiment of the present invention is confined to certain ranges for the following reasons.

The content of carbon (C) is 0.2-0.5%. The limitation of the content of carbon (C) is applied for the following reasons. When the content of carbon is less than 0.2%, it is difficult to achieve a hardness increase (i.e., excellent durability) by quench hardening. In addition, when the carbon (C) content is more than 0.5%, workability such as stretch flange formability after the spheroidizing annealing is deteriorated, since an absolute amount of the cementite which is the second phase. Therefore, it is preferable that the content of carbon (C) is 0.2-0.5%.

A content of the manganese (Mn) is 0.1-1.2%. The manganese (Mn) is added in order to prevent hot brittleness that may occur due to formation of FeS by a binding of S and Fe that are inevitably included in the manufacturing process of steel.

When the content of the manganese (Mn) is less than 0.1%, the hot brittleness occurs, and when the manganese (Mn)

content is more than 1.2%, aggregation such as center segregation or microscopic segregation increases. Therefore, it is preferable that the content of the manganese (Mn) is 0.1% to 1.2%.

The content of the silicon (Si) is less than or equal to 0.4%. When the content of the silicon (Si) is more than 0.4%, a surface quality is deteriorated due to an increase of scale defects. Therefore, it is preferable that the content of the silicon (Si) is less than or equal to 0.4%.

The content of chromium (Cr) is less than or equal to 0.5%. Chromium (Cr) as well as boron (B) is known as an element that improves hardenability of steel, and when they are added together, the hardenability of steel may be substantially improved. However, the chromium (Cr) is also known as an element that delays spheroidizing, and thus an adverse effect may occur when it is added in a large amount. Therefore, it is preferable that the content of the chromium is smaller than or equal to 0.5%.

The content of the aluminum (Al) is 0.01-0.1%. The aluminum (Al) removes oxygen existing in steel so as to prevent forming of non-metallic material, and fixes nitrogen (N) in the steel to aluminum nitride (AlN) so as to reduce the size of the grains.

However, such a purpose of addition of aluminum (Al) cannot be achieved when the content of the aluminum (Al) is less than 0.01%. In addition, when the content of the aluminum (Al) is more than 0.1%, a problem such as an increase of the steel hardness and an increase of the steel-making unit requirement may result. Therefore, it is preferable that the content of the aluminum (Al) is in the range of 0.01-0.1%.

The content of the sulfur (S) is less than or equal to 0.012%. When the content of the sulfur (S) is more than 0.012%, precipitation of manganese sulfide (MnS) may result such that the formability o steel plate is deteriorated. Therefore, it is preferable that the content of the sulfur (S) is less than or equal to 0.012%.

Titanium (Ti) removes nitrogen (N) by precipitation of titanium nitride (TiN). Therefore, consumption of boron (B) by forming boron nitride (BN) due to nitrogen (N) may be prevented. Accordingly, an adding effect of boron (B) may be achieved. The adding effect of boron (B) is described later in detail.

When the content of titanium (Ti) is less than 0.5×48/14×[N] %, the prevention of forming of the boron nitride (BN) may not be effectively achieved since the scavenging effect of nitrogen (N) from a matrix is small. Therefore, in this case, the condition of B(atomic %)/N(atomic %)>1 should be satisfied.

When the content of titanium (Ti) is greater than or equal to 0.5×48/14×[N] %, the scavenging of nitrogen (N) by the precipitation of titanium nitride (TiN) may be efficiently achieved. In this case, it is not necessary that the condition of B(atomic %)/N(atomic %)>1 is to be satisfied.

However, when the content of titanium (Ti) is greater than 0.03%, titanium carbide (TiC) is formed such that the amount of carbon (C) is decreased, in which case heat treatability decreases and steel-making unit requirement increases.

Therefore, it is preferable that the condition of B(atomic %)/N(atomic %)>1 is satisfied in the case that the content of titanium (Ti) is less than 0.5×48/14×[N] %, or that the content of titanium (Ti) is 0.5×48/14×[N] % to 0.03%.

The content of nitrogen (N) is less than or equal to 0.006%. When only the boron (B) is added without an addition of the titanium (Ti), the nitrogen (N) forms boron nitride (BN) such that the adding effect of boron (B) is suppressed. Therefore, it is preferable that the addition of nitrogen (N) is minimized. However, when the content of nitrogen (N) is more than 0.006% while the condition of B(atomic %)/N(atomic %)>1 is satisfied, the adding effect of boron (B) is reduced by an increase in the amount of precipitation. Therefore, it is preferable that the content of nitrogen (N) is less than or equal to 0.006%.

When titanium (Ti) is added, the formation of boron nitride (BN) is prevented due to the precipitation of the titanium nitride (TiN). Therefore, when the titanium (Ti) is added at more than 0.5×48/14×[N] %, the condition of B(atomic %)/N (atomic %)>1 does not need to be satisfied.

The boron (B) suppresses a transformation of austenite to ferrite or bainite, since a grain boundary energy is decreased by segregation of the boron (B) to the grain boundary or a grain boundary area is decreased by segregation of microscopic precipitate of $Fe_{23}(C, B)_6$ to the grain boundary.

In addition, the boron (B) is an alloy element that plays an important role to ensure quench hardenability in a heat treatment performed after final processing.

When the boron (B) is added at less than 0.0005%, the above-mentioned effect may not be expected. In addition, when the content of boron (B) is more than 0.0080%, a deterioration of toughness and hardenability may result due to boundary precipitation of boron (B). Therefore, it is preferable that the content of boron (B) is 0.0005%-0.0080%.

Figure 2:
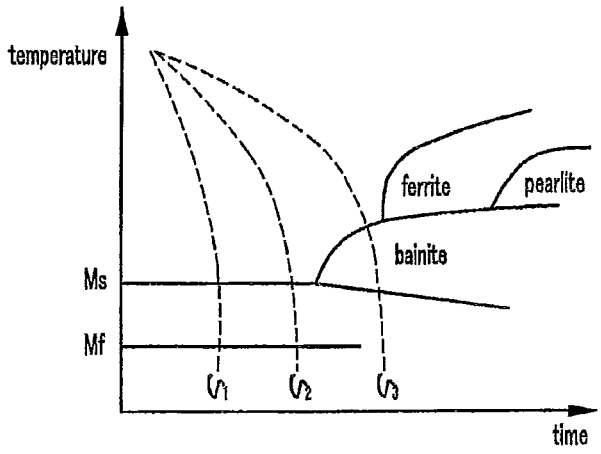
FIG. 2 is a diagram illustrating a continuous cooling of steel that is added with boron (B)

FIG. 1 and FIG. 2 are diagrams showing phase transformation control due to an addition of boron (B).

In the drawings, Ms denotes a martensite start temperature, and Mf denotes a martensite finish temperature.

FIG. 1 is a continuous cooling state diagram of a microstructure obtained when steel that is not added with boron (B) is cooled from a high temperature (for example, strip milling finishing temperature) to room temperature at various cooling speeds.

As shown in FIG. 1, in the case that the steel is not added with boron (B), a single phase of martensite is obtained when the cooling speed is $v_1$, a structure of ferrite, bainite, and martensite is obtained when the cooling speed is $v_2$, and a structure of ferrite, pearlite, and bainite is obtained when the cooling speed is $v_3$.

As shown in FIG. 2, when the steel is added with boron (B), the transformation curves of ferrite, pearlite, and bainite move to the right along the time axis, which means a delay of transformation.

That is, when the boron (B) is added, the microstructure obtained at the same cooling speed becomes from that obtained when the boron (B) is not added. That is, martensite is obtained when the cooling speed is $v_1$ or $v_2$, and a microstructure of bainite and martensite is obtained when the cooling speed is $v_3$. Accordingly, an effect of an increase in cooling speed is obtained by an addition of boron (B).

Hereinafter a manufacturing method of a carbon steel sheet according to an embodiment of the present invention is described.

Firstly, a steel slab is manufactured. The steel slab includes, in the unit of wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at less than 0.5×48/14×[N] %, B at 0.0005-0.0080%, N at less than or equal to 0.006%, Fe, and extra inevitable impurities, where the condition of B(atomic %)/N(atomic %)>1 is satisfied.

Alternatively, the steel slab includes, in the unit of wt %, C at 0.2-0.5%, Mn at 0.2-1.0%, Si at less than or equal to 0.4%, Cr at less than or equal to 0.5%, Al at 0.01-0.1%, S at less than or equal to 0.012%, Ti at 0.5×48/14×[N] to 0.03%, B at 0.005-0.0080%, N at less than or equal to 0.006%, Fe, and extra inevitable impurities. Limitations of chemical composition of the steel slab are defined for the reasons described above, and a redundant description thereof is omitted here.

Subsequently, the steel material is heated again, and a hot rolled steel sheet is manufactured by hot finish rolling at a temperature above an $Ar_3$ transformation temperature. At this time, the hot finish rolling temperature is above the $Ar_3$ transformation temperature in order to prevent rolling in a two phase region. When the rolling in the two phase region is performed, a uniform distribution of carbide over the entire structure cannot be obtained since free ferrite where carbide does not exist occurs in a large amount.

Subsequently, the manufactured hot rolled steel sheet is cooled down at a cooling speed in a range of 20° C./sec-100° C./sec. When the cooling speed after the hot rolling is less than 20° C./sec, the precipitation of ferrite and pearlite occurs in a large amount, and thus hot rolled bainite, a combined structure of bainite and martensite, or a martensite structure cannot be obtained. In addition, in order to achieve a cooling speed above 100° C./sec, new equipment such as pressurized rapid cooling equipment that is not conventional equipment is required, and this causes an increase of cost. Therefore, it is preferable that the cooling speed is in the range of 20° /C./sec-100° C./sec.

Subsequently, the hot rolled steel sheet is wound at a temperature in a range of Ms-530° C. Wien the winding temperature is above 530° C., pearlite transformation is caused such that a low temperature structure cannot be obtained, and therefore the winding temperature should be less than or equal to 530° C. When the winding temperature is less than Ms, martensitic transformation may occur during the winding such that a crack may result. Practically, the winding temperature substantially depends on performance of the winder.

A hot rolled coil is manufactured as discussed above such that free ferrite that is free from carbide, and pearlite having a lamellar carbide structure are respectively less than or equal to 5%, and a bainite phase is greater than or equal to 90%. In this case, a very small amount of martensite may be created. However, that does not cause a problem in improvement of formability that the present invention pursues when the bainite phase is greater than or equal to 90%.

Subsequently, annealing may be performed at a temperature in a range of 600° C. to Ac1 transformation temperature. When the annealing is performed at a temperature below 600° C., it becomes difficult to substantially remove electric potential resident in the structure and to achieve spheroidizing of carbide.

In addition, when the annealing is performed at a temperature above the Ac1 transformation temperature, workability is deteriorated since a reverse transformation is caused and pearlite transformation is caused during subsequent cooling. Therefore, it is preferable that the annealing is performed at a temperature in the range of 600° C. to Ac1 transformation temperature.

By suppressing creation of free ferrite and pearlite and forming a bainite structure as a principal structure as above, a carbon steel sheet having excellent formability where an average size of final carbide is less than or equal to 1 μm and an average size of grains is less than or equal to 5 μm can be manufactured.

When a manufacturing method of a hot rolled steel sheet according to the present invention as described above is utilized, a carbon steel sheet having excellent formability may be manufactured without applying conventional cold rolling.

Hereinafter, the present invention is described in further detail through embodiments. The following embodiment merely exemplifies the present invention, and the present invention is not limited thereto.

Embodiment

A steel ingot having a composition as shown in Table 1 (unit wt %) is manufactured to a thickness of 60 mm and a width of 175 mm by vacuum induction melting. The manufactured steel ingot is heated again at 1200° C. for 1 hour, and then hot rolling is applied such that a hot rolled thickness becomes 4.3 mm.

A finishing temperature of the hot rolling is set to be greater than or equal to Ar3 transformation point. After cooling to a desired hot winding temperature by cooling at an ROT cooling speed of 10° C./second, 30° C./second, and 60° C./second, the hot rolled plate is placed for one hour in a furnace heated to 450-600° C., and then the furnace is cooled. By such a process, hot rolling and winding is simulated.

A spheroidizing annealing heat treatment is performed at 640° C., 680° C., and 710° C., and results thereof are shown in Table 2.

TABLE 1

| Steel Type | C | Mn | Si | Cr | Al | S | B | N | Ti | Extra |
|---|---|---|---|---|---|---|---|---|---|---|
| A | 0.25 | 0.61 | 0.19 | 0.14 | 0.040 | 0.0033 | 0.0055 | 0.0015 | — | balance |
| B | 0.34 | 0.73 | 0.21 | 0.09 | 0.030 | 0.0027 | 0.0058 | 0.0010 | — | Fe and |
| C | 0.44 | 0.71 | 0.22 | 0.13 | 0.036 | 0.0026 | 0.0058 | 0.0014 | — | impurity |
| D | 0.37 | 0.70 | 0.17 | 0.08 | 0.042 | 0.0043 | 0.0023 | 0.0019 | 0.024 | |
| E | 0.43 | 0.71 | 0.18 | 0.13 | 0.048 | 0.0046 | 0.0021 | 0.0020 | 0.022 | |
| F | 0.35 | 0.65 | 0.22 | 0.14 | 0.040 | 0.0032 | 0.0028 | 0.0017 | — | |
| G | 0.32 | 0.76 | 0.20 | 0.09 | 0.030 | 0.0026 | — | 0.0014 | — | |
| H | 0.35 | 0.65 | 0.19 | 0.13 | 0.040 | 0.0031 | 0.0005 | 0.0049 | — | |
| I | 0.45 | 0.72 | 0.21 | 0.12 | 0.046 | 0.0025 | — | 0.0011 | — | |
| J | 0.61 | 0.43 | 0.18 | 0.14 | 0.050 | 0.0051 | 0.0041 | 0.0020 | — | |
| K | 0.34 | 0.67 | 0.18 | 0.12 | 0.030 | 0.0029 | 0.0015 | 0.0044 | — | |

Table 2 shows manufacturing conditions for steel types of Table 1, that is, cooling speeds (ROT cooling speed) after strip milling, existence/non-existence of free ferrite (regarded as non-existence when less than 5%) according to winding temperature, microstructure characteristics, and hole expansion ratios of final spheroidizing annealed plates.

Here, the hole expansion ratio is expressed as, when a circular hole formed by punching the specimen is enlarged by using a conical punch, a ratio of the amount of hole expansion before a crack at at least one location on an edge of the hole stretches fully across the hole in the thickness direction with respect to an initial hole. The hole expansion ratio is known as an index for rating stretch flange formability and is expressed as Equation 1 below.

$$\lambda=(Dh-Do)/Do\times 100(\%) \quad \text{Equation 1}$$

Here, λ denotes the hole expansion ratio (%), Do denotes the initial hole diameter (10 mm in the present invention), and Dh denotes a hole diameter (mm) after the cracking.

In addition, a definition for a clearance at the time of punching the initial hole is required for rating the above-mentioned hole expansion ratio. The clearance is expressed as a ratio of a gap between the die and the punch with respect to a thickness of a specimen. The clearance is defined by the following Equation 2, and according to an embodiment of the present invention, a clearance of about 10% is used.

TABLE 2

| Remark | ROT cooling speed (° C./sec.) | Winding temp. (° C.) | Existence of Free ferrite (Yes/No) | Spheroidizing temp (° C./time(hr) | Ferrite average diameter (μm) | Carbide average diameter (μm) | Hole expansion ratio (λ %) | Steel Type |
|---|---|---|---|---|---|---|---|---|
| Comp. Ex. 1 | 10 | 450 | Yes | 680/30 | 17.8 | 0.68 | 67.0 | A |
| Experimental Ex. 1 | 30 | 450 | No | 680/30 | 4.3 | 0.21 | 120.4 | |
| Experimental Ex. 2 | 70 | 450 | No | 680/30 | 4.1 | 0.20 | 122.8 | |
| Comp. Ex. 2 | 10 | 500 | Yes | 640/40 | 7.5 | 0.69 | 48.0 | B |
| Comp. Ex. 3 | | | Yes | 680/30 | 7.6 | 0.71 | 49.7 | |
| Comp. Ex. 4 | | | Yes | 710/10 | 7.8 | 0.73 | 50.4 | |
| Experimental Ex. 3 | 30 | 500 | No | 640/40 | 2.4 | 0.48 | 57.1 | |
| Experimental Ex. 4 | | | No | 680/30 | 2.5 | 0.55 | 59.3 | |
| Experimental Ex. 5 | | | No | 710/10 | 2.5 | 0.52 | 67.1 | |
| Experimental Ex. 6 | 70 | 500 | No | 710/10 | 2.4 | 0.49 | 69.2 | |
| Comp. Ex. 5 | 30 | 600 | Yes | 680/30 | 15.2 | 1.03 | 52.5 | |
| Comp. Ex. 6 | 10 | 500 | Yes | 680/30 | 7.1 | 1.41 | 39.3 | C |
| Experimental Ex. 7 | 30 | 500 | No | 680/30 | 2.3 | 0.88 | 51.7 | |
| Comp. Ex. 7 | 30 | 600 | Yes | 680/30 | 10.0 | 1.17 | 40.3 | |
| Comp. Ex. 8 | 10 | 500 | Yes | 680/30 | 7.7 | 0.73 | 47.2 | D |
| Comp. Ex. 9 | | | Yes | 710/10 | 7.7 | 0.74 | 49.1 | |
| Experimental Ex. 8 | 30 | 500 | No | 680/30 | 2.4 | 0.54 | 58.4 | D |
| Experimental Ex. 9 | | | No | 710/10 | 2.5 | 0.53 | 64.3 | |
| Comp. Ex. 10 | 30 | 600 | Yes | 680/30 | 13.4 | 1.01 | 47.2 | |
| Comp. Ex. 11 | 10 | 450 | Yes | 680/30 | 7.0 | 1.31 | 38.9 | E |
| Experimental Ex. 10 | 30 | 450 | No | 680/30 | 2.1 | 0.74 | 49.7 | |
| Experimental Ex. 11 | 30 | 500 | No | 710/10 | 2.4 | 0.52 | 61.1 | F |
| Comp. Ex. 12 | 30 | 600 | Yes | 710/10 | 12.4 | 1.12 | 46.2 | |
| Comp. Ex. 13 | 10 | 500 | Yes | 680/30 | — | Non-spheroidized | 40.0 | G |
| Comp. Ex. 14 | 30 | 500 | Yes | 680/30 | 7.8 | 0.74 | 49.6 | |
| Comp. Ex. 15 | 30 | 600 | Yes | 680/30 | — | Non-spheroidized | 44.0 | |
| Comp. Ex. 16 | 30 | 500 | Yes | 680/30 | 8.1 | 0.73 | 48.7 | H |
| Comp. Ex. 17 | | | Yes | 710/10 | 8.3 | 0.77 | 49.9 | |
| Comp. Ex. 18 | 30 | 600 | Yes | 680/30 | — | Non-spheroidized | 41.3 | |
| Comp. Ex. 19 | | | Yes | 710/10 | — | Non-spheroidized | 42.7 | |
| Comp. Ex. 20 | 10 | 450 | Yes | 680/30 | — | Non-spheroidized | 28.3 | I |
| Comp. Ex. 21 | 30 | 450 | Yes | 680/30 | 7.2 | 1.37 | 36.4 | |
| Comp. Ex. 22 | 30 | 500 | No | 680/30 | 5.5 | 0.82 | 34.4 | J |
| Comp. Ex. 23 | 30 | 600 | Yes | 680/30 | — | Non-spheroidized | 23.6 | |
| Comp. Ex. 24 | 30 | 500 | Yes | 710/10 | 7.9 | 0.75 | 50.1 | K |
| Comp. Ex. 25 | 30 | 600 | Yes | 710/10 | — | Non-spheroidized | 42.3 | |

$$C=0.5\times(d_d-d_p)/t\times100(\%) \quad \text{Equation 2}$$

Here, C denotes the clearance (%), $d_d$ denotes an interior diameter (mm) or the punching die, $d_p$ denotes a diameter ($d_p$=10 mm) of the punch, and t denotes a thickness of the specimen.

The existence ("Yes" or "No") of free ferrite depends on whether the final hot rolling is performed under a temperature below the Ar3 transformation point. In addition, it also depends on the cooling speed (ROT cooling speed) after the strip milling, and on the winding temperature.

That is, although the Ar3 transformation temperature principally depends on the cooling speed after starting of the cooling in the austenite region, the hot rolling below the Ar3 transformation point implies creation of free ferrite, and this causes non-uniform distribution of cementite. In addition, it is well known that ferrite and pearlite transformation is caused as the run out table (ROT) cooling speed becomes slower, and the ferrite and pearlite transformation can be prevented as the cooling speed becomes faster.

In addition, the probability of free ferrite existence becomes lower as the winding temperature at which the hot rolling transformation is finished becomes lower. This coincides with the fact that, as shown in Table 2, free ferrite occurs by a larger amount when the winding temperature becomes higher even if the composition and cooling conditions are the same. Regarding the existence of free ferrite in Table 2, it is marked as "Yes" if the amount of free ferrite is more than 5%, and it is marked as "No" if the amount thereof is less than or equal to 5%. The inventive steel of a composition of the present invention only relates to the cases in which the existence of free ferrite is marked as "No".

According to the present invention, a final spheroidizing annealed plate includes uniform distribution of a very small amount of carbide by spheroidizing annealing without cold rolling after the manufacturing of the hot rolled plate. This may be enabled if creation of free ferrite and pearlite in the hot rolled plate is suppressed and instead the creation of bainite structure is created.

When the free ferrite exists in the hot rolled plate, the carbide distribution in the final spheroidizing annealed plate becomes non-uniform, since the carbide hardly exists in the free ferrite, and such a microstructure characteristic is maintained at the final spheroidizing annealed plate according to a manufacturing process of the present invention.

In addition, when the bainite structure is created in the hot rolled plate, spheroidizing is possible even if the annealing is performed for a very short period in comparison with the case that a conventional pearlite structure is transformed into spheroidized cementite. For example the annealing period at 710° C. according to an embodiment is about 10 hours.

Ferrite diameter after the final spheroidizing annealing is shown in Table 2. Although an average grain size of the inventive steel becomes as fine as below 5 μm, the ferrite grain of the comparison steel having free ferrite becomes very large in comparison with the inventive steel. The steel type J is classified as a comparison steel although the existence of free ferrite is "No", since the composition of carbon is out of the range of the present invention.

Figure 3:
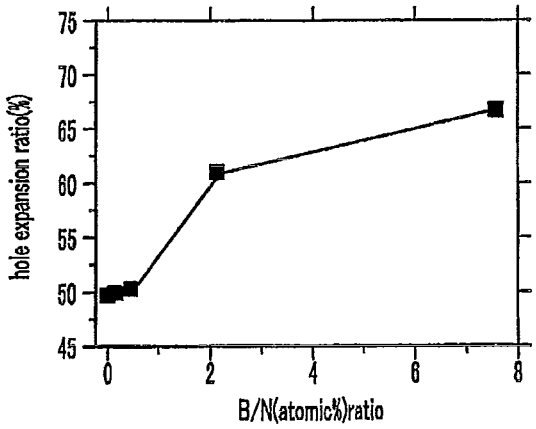
FIG. 3 is a graph showing a relationship of a hole expansion ratio with respect to a ratio in atomic % of boron (B) and nitrogen (N)

FIG. 3 is a graph showing a relationship of the hole expansion ratio with respect to atomic % ratios of boron (B) and nitrogen (N). It can be seen that hole expansion ratio is very low when the B(atomic %)/N(atomic %) ratio is less than 1, and the hole expansion ratio is very high when the same is greater than or equal to 1. By this fact, it can be understood that B that is not combined with N effectively delays the phase transformation.

Ferrite diameter after the final spheroidizing annealing has a relationship with hot rolled microstructure and carbide size. When free ferrite or pearlite exists in the hot rolled microstructure, the final ferrite grain becomes larger since the ferrite diameter increases and the carbide size also increased due to locality in the existence of carbide.

It is well known that toughness is improved as the final ferrite grain becomes finer, and this forms an additional merit of the present invention. The same as described in connection with ferrite grain size, the carbide average diameter also increases due to concentrated creation at a local region of carbide in the case that the free ferrite exists, and accordingly an overall non-uniform distribution is caused. This may cause deterioration of the hole expansion ratio and coarsening of ferrite grain.

Figure 4:
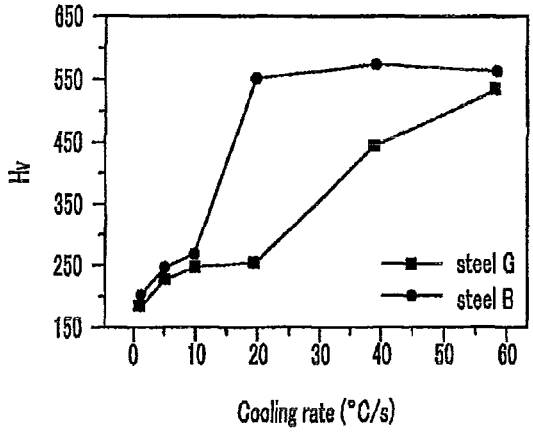
FIG. 4 is a graph showing hardness values of steel that is added with boron (B) and steel that is not added with boron (B) depending on the cooling speed.

FIG. 4 is a graph showing hardness values of steel that is added with boron (B) and steel that is not added with boron (B) depending on the cooling speed.

It can be understood that the hardness value of steel B that is effectively added with B is found to be almost uniform at cooling speeds above about 20° C./second, while the hardness value of steel G that is not added with B varies a lot as the cooling speed varies. That is, since B delays the phase transformation and accordingly improves hardenability, hardness deviation after a final heat treatment process that may be performed after a final forming can be decreased or hardness can be improved.

As described above, according to an embodiment of the present invention, a carbon steel sheet having excellent stretch flange formability and microscopic and uniform carbide distribution can be obtained even if the cooling speed is low. Therefore, an effect that investment for expensive equipment is reduced can be expected.

In addition, according to an embodiment of the present invention, hardness deviation after a final heat treatment process that may be performed after a final forming can be decreased or hardness can be improved.

While this invention has been described in detail in connection with an embodiment of the present invention, the scope of the present invention is not limited thereto, but various variations and developments by a person of ordinary skill in the art using the base concept of the present invention defined in the claims is included in the scope of the present invention.

The invention claimed is:

1. A carbon steel sheet having excellent formability, wherein:

the carbon steel sheet comprises, in the unit of wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at less than 0.5×48/14×[N]%, B at 0.0005-0.0080%, N at less than or equal to 0.006%, Fe, and extra inevitable impurities, wherein the condition of B(atomic %)/N(atomic %)>1 is satisfied;

an average particle size of carbide in the carbon steel sheet is less than or equal to 1 μm;

an average grain size of ferrite in the carbon steel sheet is less than or equal to 5 μm; and fractions of free ferrite and pearlite having a lamellar carbide structure are respectively less than or equal to 5%, and that of bainite is greater than or equal to 90%.

2. A manufacturing method of carbon steel sheet having excellent formability, the method comprising:

manufacturing a steel slab that comprises, in the unit of wt %, C at 0.2-0.5%, Mn at 0.1-1.2%, Si at less than or equal to 0.4%, Cr at less than or equal to 0.5%, Al at 0.01-0.1%, S at less than or equal to 0.012%, Ti at less than 0.5×48/14×[N]%, B at 0.0005-0.0080%, N at less than or equal to 0.006%, Fe, and extra inevitable impurities, wherein the condition of B(atomic %)/N(atomic %)>1 is satisfied;

manufacturing a hot rolled steel sheet by reheating and hot rolling the slab with a finishing temperature that is greater than or equal to an $Ar_3$ transformation temperature;

cooling the hot rolled steel sheet at a cooling speed in a range of 20° C./sec-100° C./sec; and manufacturing a hot rolled coil by winding the cooled hot rolled steel sheet at a temperature in a range of Ms to 530° C., wherein, in the hot rolled coil, fractions of free ferrite and pearlite having a lamellar carbide structure are respectively less than or equal to 5%, and that of bainite is greater than or equal to 90%, and wherein an average particle size of carbide in the carbon steel sheet is less than or equal to 1 μm, and an average grain size of ferrite in the carbon steel sheet is less than or equal to 5 μm.

3. The manufacturing method of claim 2, further comprising annealing the hot rolled steel sheet at a temperature range of 600° C. to $Ac_1$ transformation temperature.

* * * * *